US011643306B1

(12) United States Patent
Yang et al.

(10) Patent No.: US 11,643,306 B1
(45) Date of Patent: May 9, 2023

(54) WINCH INTEGRATED WITH PERMANENT MAGNET BRUSHLESS MOTOR AND CONTROLLER

(71) Applicant: Zhejiang Nowvow Mechanical and Electrical Corp., Ltd, Zhejiang (CN)

(72) Inventors: Yong Yang, Zhejiang (CN); Kunlei Zhao, Zhejiang (CN); Jun Zhou, Zhejiang (CN); Chunxiang Zhang, Zhejiang (CN); Liangdao Tang, Zhejiang (CN); Guogang Zhang, Zhejiang (CN)

(73) Assignee: Zhejiang Nowvow Mechanical and Electrical Corp., Ltd, Zhejiang (CN)

( * ) Notice: Subject to any disclaimer, the term of this patent is extended or adjusted under 35 U.S.C. 154(b) by 0 days.

(21) Appl. No.: 17/883,620

(22) Filed: Aug. 9, 2022

(30) Foreign Application Priority Data

| | | |
|---|---|---|
| Mar. 23, 2022 | (CN) | 202220649096.4 |
| May 30, 2022 | (CN) | 202221341188.2 |
| Jun. 6, 2022 | (CN) | 202221425888.X |
| Jun. 15, 2022 | (CN) | 202221503693.2 |

(51) Int. Cl.
*B66D 1/12* (2006.01)
*B66D 1/22* (2006.01)

(52) U.S. Cl.
CPC ..... *B66D 1/12* (2013.01); *B66D 1/22* (2013.01); *B66D 2700/0141* (2013.01)

(58) Field of Classification Search
CPC ..... B66D 1/12; B66D 2700/0141; H02K 7/1016; H02K 1/2786
See application file for complete search history.

(56) References Cited

U.S. PATENT DOCUMENTS

| | | | | |
|---|---|---|---|---|
| 1,937,404 | A * | 11/1933 | Dudick | H02K 7/106 318/744 |
| 6,328,136 | B1 * | 12/2001 | Tauchi | H02K 29/08 187/391 |
| 6,891,299 | B2 * | 5/2005 | Coupart | H02K 5/04 310/156.43 |
| 7,080,825 | B1 * | 7/2006 | George | B66D 3/18 254/362 |
| 8,985,555 | B2 * | 3/2015 | Cryer | B66D 1/22 254/290 |

(Continued)

FOREIGN PATENT DOCUMENTS

| | | | |
|---|---|---|---|
| CN | 113060665 | A * | 7/2021 |
| JP | 2019202837 | A * | 11/2019 |

*Primary Examiner* — Sang K Kim
*Assistant Examiner* — Nathaniel L Adams
(74) *Attorney, Agent, or Firm* — JCIPRNET

(57) ABSTRACT

A winch integrated with a permanent magnet brushless motor and a controller includes a brushless motor and a controller. The brushless motor includes a stator having a wire coil, and a motor bracket. The stator is fixedly provided in the motor bracket. A rotor and a rotating shaft fixed in a rotor center are provided inside the stator. The rotating shaft is rotatably connected to the motor bracket, one end of the rotating shaft is fixedly connected with a magnet mount, and a cylinder magnet is mounted in the magnet mount. The controller includes a control circuit board fixed to one end of the motor bracket proximal to the cylinder magnet. A sensor chip for angle sensing in conjunction with the cylinder magnet is provided on the control circuit board.

11 Claims, 11 Drawing Sheets

(56) References Cited

U.S. PATENT DOCUMENTS

| | | | | |
|---|---|---|---|---|
| 9,022,358 | B2 * | 5/2015 | Williams | H02K 3/28 254/362 |
| 9,463,965 | B2 * | 10/2016 | Heravi | B66D 1/12 |
| 10,870,562 | B2 * | 12/2020 | Thirunarayana | H02K 7/116 |
| 10,934,141 | B2 * | 3/2021 | Brady | B66D 1/485 |
| 11,242,230 | B2 * | 2/2022 | Kou | H02K 1/2786 |
| 2010/0127229 | A1 * | 5/2010 | Kverneland | B66D 5/14 254/342 |

* cited by examiner

WINCH INTEGRATED WITH PERMANENT MAGNET BRUSHLESS MOTOR AND CONTROLLER

CROSS-REFERENCE TO RELATED APPLICATION

This application claims the priority benefit of China application no. 202220649096.4, filed on Mar. 23, 2022, China application no. 202221341188.2 filed on May 30, 2022, China application no. 202221425888.X filed on Jun. 6, 2022, and China application no. 202221503693.2 filed on Jun. 15, 2022. The entirety of each of the above-mentioned patent applications is hereby incorporated by reference herein and made a part of this specification.

BACKGROUND

Technical Field

The disclosure relates to electric traction, and more particularly relates to a winch integrated with a permanent magnet brushless motor and a controller.

Description of Related Art

A winch is a towing apparatus geared to maneuver an object. The winch is powered by an electric motor to output. Pulling of the winch is realized when the gear train in a reduction gearbox is driven via a coupling and a driving rod to move a drum to rotate and respool the rope wound around the drum. Operating of the winch may be controlled in a wired or wireless mode by a controller. Conventional winches in the market are generally driven by a brushed motor, the commutator carbon brush of which easily get frayed and is inconvenient to change. In addition, a control box assembly for controlling a forward reverse relay needs to be provided, which results in a bulky size and unstable relay contact. The electric motor and the relay are connected via a wire, but if the wire is overly long, electrical energy loss and voltage drop occur. The relay contacts are prone to adhesion or loose contact, potentially causing safety hazards. Moreover, the whole set is inefficient with a high energy consumption. In conventional electric winches powered by a brushless motor, the brushless motor and the controller are generally separately designed, rendering a low integration level.

SUMMARY

A winch integrated with a permanent magnet brushless motor and a controller is provided, which uses a brushless motor assembly to actuate the winch, thereby rendering a compact structure and a simplified wiring. The disclosure significantly improves the overall efficiency and reduces energy consumption. In addition, the brushless motor assembly integrates the brushless motor and the controller, which reduces the overall cost and enhances reliability.

The disclosure is implemented through the following technical solutions:

A winch integrated with a permanent magnet brushless motor and a controller comprises a brushless motor and a controller. The brushless motor comprises a stator having a wire coil, and a motor bracket, the stator is fixedly provided in the motor bracket, a rotor and a rotating shaft fixed in a rotor center are provided inside the stator, and the rotating shaft is rotatably connected to the motor bracket. One end of the rotating shaft is fixedly connected with a magnet mount, and a cylinder magnet is mounted in the magnet mount. The controller comprises a control circuit board, and the control circuit board is fixed to one end of the motor bracket proximal to the cylinder magnet. A sensor chip for angle sensing in conjunction with the cylinder magnet is provided on the control circuit board.

In some embodiments, the motor bracket comprises a motor tail cap, the controller further comprises a controller end cap, and an accommodation cavity is formed between the motor tail cap and the controller end cap. The cylinder magnet passes through the motor tail cap to extend into the accommodation cavity, and the control circuit board is fixed in the accommodation cavity. The connection between the motor tail cap and the controller end cap renders the overall structure of the brushless motor assembly more compact, and the controller end cap may better protect the circuit board from accidental damages to the control circuit board.

In some embodiments, an opening is provided in a sidewall of the accommodation cavity, and a connection wire passes through the opening and is connected to the control circuit board. Or, a wiring lug is provided in the opening, and the control circuit board and the connection wire are electrically connected to the wiring lug respectively. By providing the opening provided in the sidewall of the accommodation cavity or the motor tail cap, the overall mount length required by the brushless motor is effectively reduced such that the brushless motor is adapted to be mounted in a narrower space.

In some embodiments, a cross section of the controller end cap has a regular polygonal or round shape, a recessed cavity is provided in the controller end cap, the motor tail cap encloses the recessed cavity to form the accommodation cavity, and the opening is provided in a sidewall of the recessed cavity. Since the cross section of the controller end cap has a regular polygonal or round shape, the controller end cap may be rotated till an appropriate angle along the rotating shaft of the brushless motor so as to reach a better mounting position, allowing the opening to face an appropriate direction.

In some embodiments, the stator comprises an iron core and a three-phase wire coil wound around the iron core, and an output wire of the three-phase wire coil is connected to a corresponding contact on the control circuit board. This setting may avoid an overly long wire connection between the electric motor and the relay, whereby to reduce electrical energy loss.

In some embodiments, a first fixation hole running along an axis of the rotating shaft is provided in an end surface of the rotating shaft, and one end of the magnet mount is adapted to the first fixation hole. A second fixation hole running co-axially with the rotating shaft is provided at another end of the magnet mount, and the cylinder magnet is fixed in the second fixation hole. This structural setting may ensure co-axial rotation between the cylinder magnet and the rotary shaft, whereby to control rotor rotation more precisely.

In some embodiments, the motor bracket comprises a motor end cap, a motor casing, and a motor tail cap, one end of the motor casing is integrally formed with the motor end cap, and another end of the motor casing is detachably connected to the motor tail cap. Or, the motor bracket comprises the motor end cap, the motor casing, and the motor tail cap, the motor end cap is detachably connected to one end of the motor casing, and the another end of the motor casing is detachably connected to the motor tail cap. The motor end cap may be separately or integrally formed with the motor casing. This flexible setting is adapted to different scenarios or different models of winches.

In some embodiments, a front end of the rotating shaft is rotatably connected on the motor end cap via a bearing, and a rear end of the rotating shaft is rotatably connected on the motor tail cap via a bearing. With the bearing, the rotating shaft is fitted with the motor end cap and the motor tail cap, realizing a rotatable connection between the rotating shaft and the motor bracket. The bearing renders a higher stability and a lower fault rate, whereby to ensure long-term, stable rotation of the rotating shaft.

In some embodiments, the stator comprises an iron core, and the iron core is stamped-out and laminated from a silicon steel sheet. This feature offers a better electric performance to the stator.

In some embodiments, the winch further comprises a reduction gearbox, a drum, and a rope wound around the drum. The other end of the rotating shaft actuates the reduction gearbox to rotate via a driving rod, the reduction gearbox drives the drum to rotate, and the drum brings the rope to wind to implement pulling of the winch.

Compared with conventional technologies, the disclosure offers the following benefits.

By fixing the controller to the end of a motor tail cap proximal to the cylinder magnet, the issue of the overly long distance between the sensor and the cylinder magnet in a conventional brushless motor is resolved, the interval between the control circuit board and the cylinder magnet is reduced, the control box assembly and connection wires are eliminated, and manufacturing and installation are facilitated. In the disclosure, by integrating the brushless motor and the controller, the overall length of the electric winch is reduced, whereby to reduce footprint, facilitate mold making, reduce manufacture cost, enhance reliability, and simplify wiring of the whole set.

DESCRIPTION OF THE EMBODIMENTS

Figure 1:
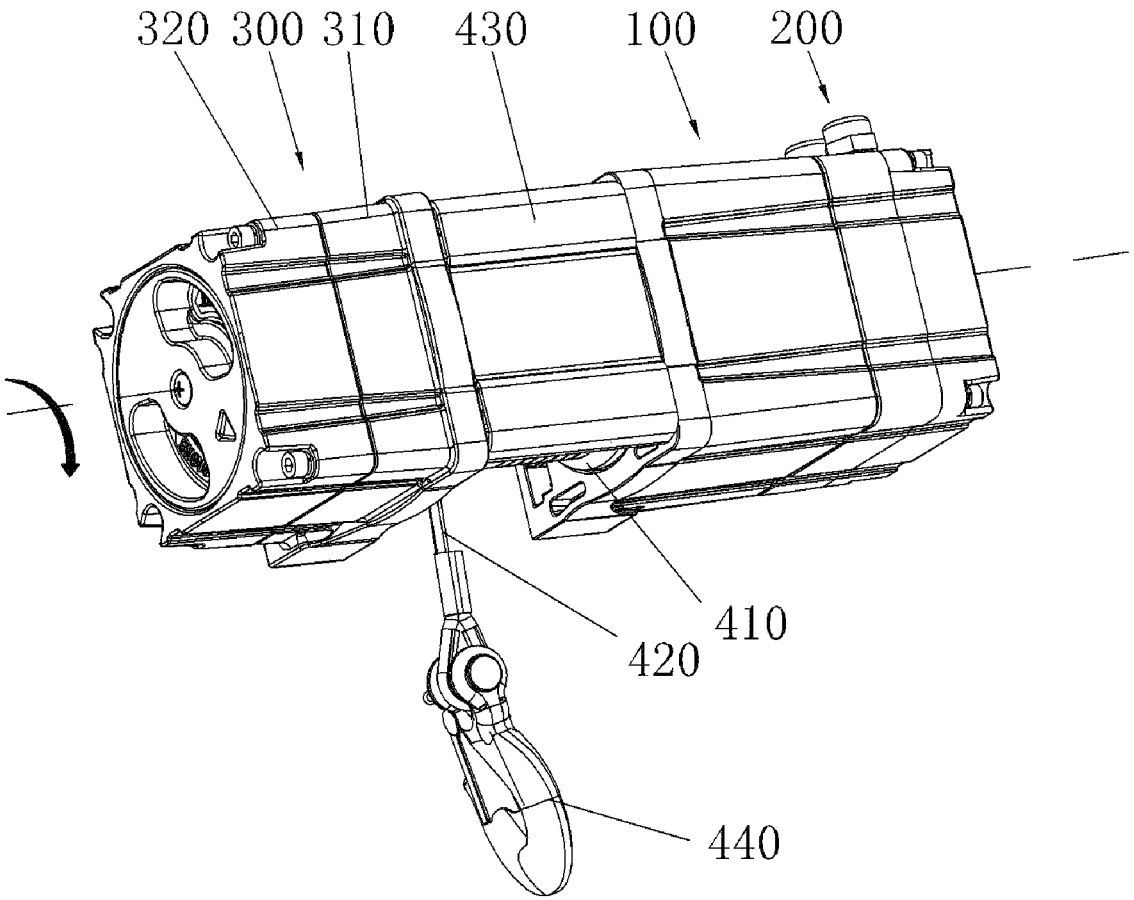
FIG. 1 is a schematic diagram showing a structure of a first implementation of a winch integrated with a permanent magnet brushless motor and a controller according to the disclosure.

A winch integrated with a permanent magnet brushless motor and a controller is provided. The winch comprises a brushless motor and a controller. The brushless motor comprises a stator having a wire coil, and a motor bracket, and the stator is fixedly provided in the motor bracket. A rotor and a rotating shaft fixed in the rotor center are provided in the stator. The rotating shaft is rotatably connected to the motor bracket, one end of the rotating shaft is fixedly connected with a magnet mount, and a cylinder magnet is mounted in the magnet mount. The controller comprises a control circuit board, and the control circuit board is fixed to one end of the motor bracket proximal to the cylinder magnet. A sensor chip for angle sensing in conjunction with the cylinder magnet is provided on the control circuit board. By fixing the controller to the end of a motor tail cap proximal to the cylinder magnet, the issue of the overly long distance between the sensor and the cylinder magnet in a conventional brushless motor is resolved, the interval between the control circuit board and the cylinder magnet is reduced, the control box assembly and connection wires are eliminated, and manufacturing and installation are facilitated. In the disclosure, by integrating the brushless motor and the controller, the overall length of the electric winch is reduced, whereby to reduce footprint, facilitate mold making, reduce manufacture cost, enhance reliability, and simplify wiring of the whole set.

Hereinafter, the implementations of the present disclosure will be described in detail. Examples of the implementations are shown in the drawings. The implementations described with reference to the accompanying drawings are intended to explain the present disclosure, which shall not be construed as limiting the present disclosure.

In the description of the present disclosure, it needs to be understood that the orientational or positional relationships indicated by the terms "center," "longitudinal," "transverse," "length," "width," "thickness", "upper," "lower," "front," "rear," "left," "right," "vertical," "horizontal," "top," "bottom," "inner," and "outer," etc. are orientational and positional relationships based on the drawings, which are intended only for facilitating or simplifying description of the present disclosure, not for indicating or implying that the devices or elements have to possess those specific orientations and have to be configured and operated with such specific orientations; therefore, they should not be understood as limitations to the present disclosure.

Besides, the terms "first" and "second" are only used for description purposes, which shall not be construed as indicating or implying a relative importance or implicitly indicating the number of the technical features indicated. Therefore, the features limited by "first" and "second" may explicitly or implicitly include at least one of such features. In the description of the present disclosure, "plurality" indicates at least two, for example, two, three, etc., unless otherwise indicated.

In the present disclosure, unless otherwise explicitly provided and limited, the terms such as "mount," "attach," "connect," and "fix" should be understood broadly, which, for example, may refer to a secured connection, a detachable connection, or an integral connection; which may be a mechanical connection or an electrical connection; which may be a direct connection or an indirect connection via an intermediate medium; which may also be a communication between the insides of two elements or an interactive relationship between the two elements, unless otherwise explicitly defined. To a person of normal skill in the art, specific meanings of the above terms in the present disclosure may be understood based on specific situations.

First Implementation

FIG. 1 illustrates a first implementation of a winch integrated with a permanent magnet brushless motor and a controller. This implementation is applicable to an AC (alternate current) electric winch. The winch comprises a brushless motor 100, a controller 200, and a reduction gearbox 300. The reduction gearbox 300 comprises a gear housing formed by a reduction gearbox casing 310 and a reduction gearbox end cap 320 which are connected to each other. One or more stages of a speed reduction mechanism and a clutch assembly may be installed in the gear housing. Types of the speed reduction mechanism include, but are not limited to, a differential gear type, a planetary gear type, or a spur plus planetary gear type. The brushless motor 100 comprises a motor bracket 120. The motor bracket 120 comprises a motor tail cap 121, a motor end cap 122 and a motor casing 123 which are integrally formed with each other. The controller 200 comprises a controller end cap 220. A stator 110 and a rotor 130 of the brushless motor 100 are disposed in a space formed by the motor bracket 120 and the motor tail cap 121 being combined, while the controller 200 is installed in an accommodation cavity 221 formed by the motor tail cap 121 and the controller end cap 220 being combined. The controller 220, which is configurable for speed control of the brushless motor 100, may adjust speeds and maintain a constant rotating speed. In some implementations, the motor tail cap 121 may be directly and fixedly connected to the motor bracket 120, and the controller end cap 220 may be directly and fixedly connected with the motor tail cap 121. A specific implementation of the fixation may be bolting or otherwise. The motor bracket 120 and the gear housing may be connected via a drum support 430, and a drum 410 is mounted in the drum support 430, i.e., the drum 410 is disposed between the motor bracket 120 and the gear housing.

The output shaft of the brushless motor 100 drives the reduction gearbox 300 via a coupling and a driving rod to move the drum 410 to rotate about the axial direction (as shown in the arrow of the figure) or rotate about a direction reverse thereto. For example, the brushless motor 100 is driven along the first direction in FIG. 1, causing the drum 410 to rotate about the winding mandrel, and the brushless motor 100 may be alternately driven about a direction reverse to the first direction. In this example, a rope 420 may be wound around the outer surface of the drum 410. The projected end of the rope 420 may be attached to a hook 440 to facilitate connection between the rope 420 and a to-be-towed object, whereby to perform a towing operation. In this implementation, the brushless motor 100 is driven to rotate about the arrow direction in FIG. 1, whereby to realize rope extension and retraction.

Figure 2:
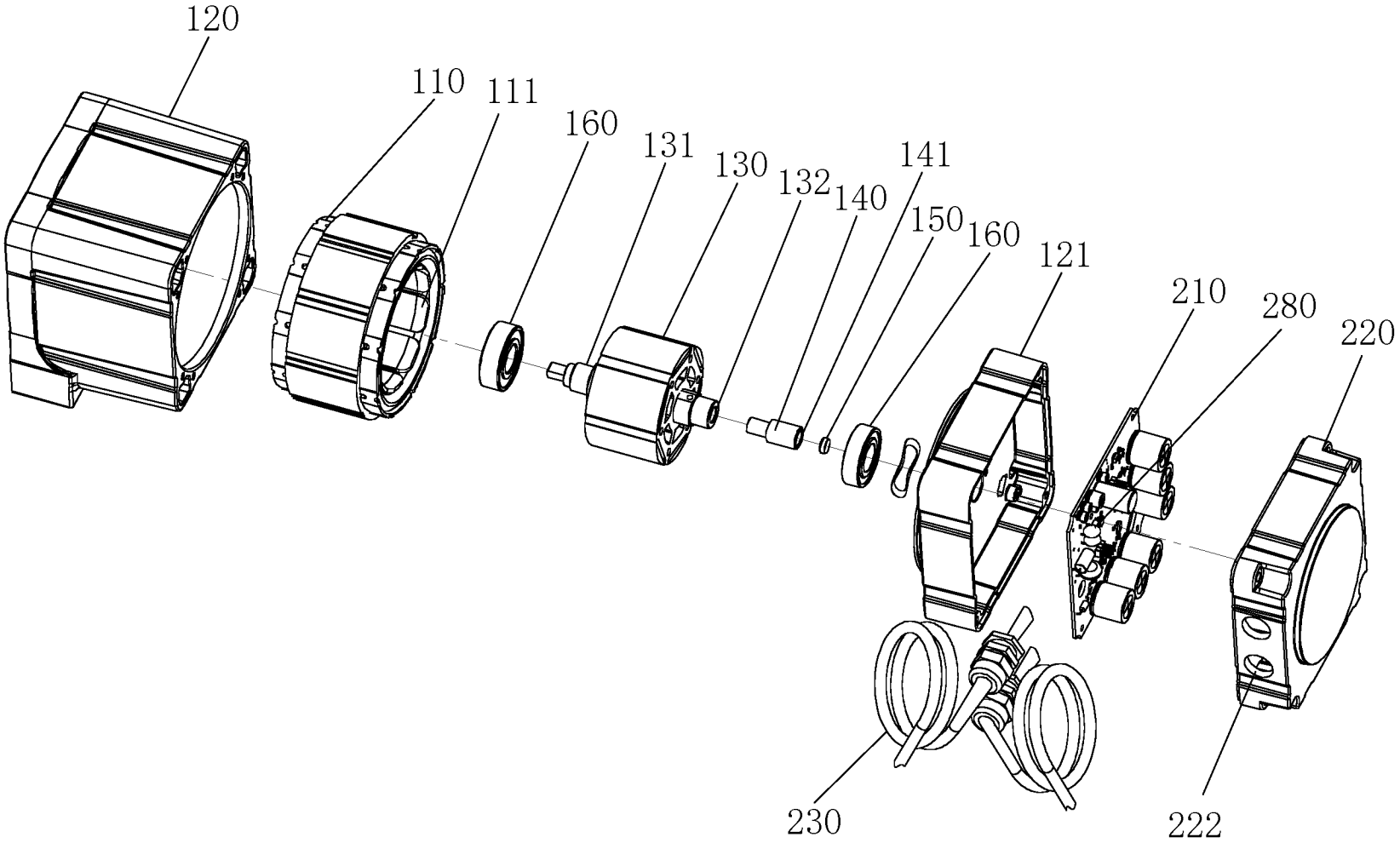
FIG. 2 is an exploded diagram of the first implementation of the winch integrated with a permanent magnet brushless motor and a controller according to the disclosure.
Figure 3:
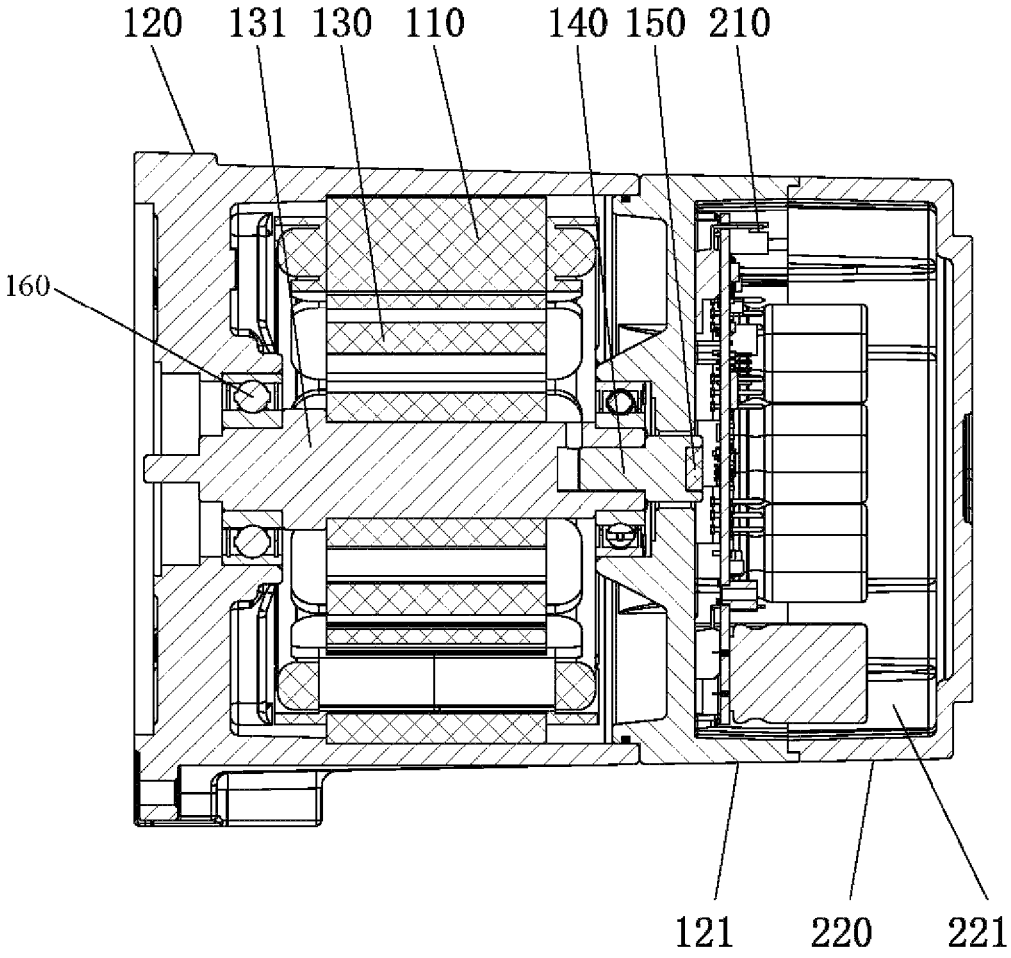
FIG. 3 is a sectional view of the brushless motor and the controller in the first implementation of the winch with a permanent magnet brushless motor and a controller according to the disclosure.

Referring to FIG. 2 and FIG. 3, the winch comprises a wire 230 extending outward from the controller 200 in the interior of the space formed by the motor tail cap 121 and the controller end cap 220 being combined, and the wire 230 may be fixed to an opening 222 at the controller end cap 220 side. One or both of the motor tail cap 121 and the controller end cap 220 are provided with a recessed cavity, and the accommodation cavity 221 is formed by the motor tail cap 121 and the controller end cap 220 being combined, i.e., the opening 222 may be either provided in the motor tail cap 121 or provided in the controller end cap 220. In this implementation, the wire 230 connected to a receptacle allows the current to flow through a control circuit board 210 to the brushless motor 100, without a need for a control box assembly an additional wire harness for the connection.

The control circuit board 210 is mounted in the space formed by the motor tail cap 121 and the controller end cap 220. The stator 110 comprises an iron core. A three-phase wire coil 111 is provided on the iron core, and an output wire of the three-phase wire coil 111 is directedly connected to a corresponding contact on the control circuit board 210. Such configuration can reduce additional harness connectors, shorten the length of the connecting line between the brushless motor 100 and the control circuit board 210, reduce electrical energy loss to improve efficiency of the brushless motor 100, and further reduce energy consumption.

FIG. 2 is an exploded view of the brushless motor 100 and the controller 200. The control circuit board 210, which is integrated with a plurality of components for reading or storage functionalities, is fixed on the motor tail cap 121 via an intermediate medium (e.g., a bolt). The stator 110 is sleeved in the motor bracket 120, and the rotor 130 with a permanent magnet provided on its outer surface is mounted via a bearing 160 in the space formed by the motor bracket 120 and the motor tail cap 121 being combined. The controller end cap 220 and the motor tail cap 121 are fastened via a fastener (e.g., a screw, which is not shown), thereby rendering the brushless motor 100 and the controller 200 integrated.

As illustrated in FIG. 3, the iron core of the stator 110 is stamped-out and laminated from a silicon steel sheet. The stator 110 is fixed in the interior of the motor bracket 120. When energized, the coil of the stator 110 produces a magnetic field. One end of the rotating shaft 131 in the rotor 130 with a permanent magnet is connected on the motor tail cap 121 via the bearing 160, and the other end of the rotating shaft 131 is connected on the motor bracket 120 via the bearing 160. One end of the rotating shaft 131 in the rotor 130 is mounted with a magnet mount 140, and the motor bracket 120 and the motor tail cap 121 are connected by a plurality of fasteners (e.g., screws, not shown). Specifically, a first fixation hole 132 running along the axis of the rotating shaft 131 is provided in the end surface of the rotating shaft 131, and one end of the magnet mount 140 is adapted to the first fixation hole 132. A second fixation hole 141 running co-axially with the rotating shaft 131 is provided in the other end of the magnet mount 140, the cylinder magnet 150 is fixed in the second fixation hole 141, and in this way, the cylinder magnet 150, the magnet mount 140, and the rotor 130 are integrally connected. A position of the rotation angle of the rotor 130 is sensed in real time by a sensor chip 280 on the control circuit board 210 fixed in the plane of the motor tail cap 121. The coil connector of the stator 110 is connected to each phase terminal of the control circuit board 210. When a position sensor on the control circuit board 210 is switched on, the corresponding phase coil is energized, causing the stator 110 to produce a rotating magnetic field with uniformly varied directions, and then the rotor 130 may rotate following the magnetic field, which allows the brushless motor 100 to provide a rated torque from zero rotating speed to the rated speed of rotation. The rotating shaft 131 of the rotor 130 is transmitted via the gear train in the reduction gearbox 300 to drive the drum 410 assembly mounted on the drum support 430 to rotate about the first direction of the winding mandrel of the winch as illustrated in FIG. 1 or about a direction reverse thereto.

As mentioned above, the motor tail cap 121 and the controller 200 in the interior of the controller end cap 220 are connected via an outwardly extending wire 230. The wire 230 may be fixed to a circular opening 222 at the controller end cap 220 side via an intermediate medium (e.g., a water-proof connector), one end of the wire 230 is connected on the control circuit board 210. In this implementation, the wire 230 connected to a receptacle allows the current to directly flow into the brushless motor 100 through the connecting line between the control circuit board 210 and the brushless motor 100, which eliminates the need for a control box assembly and an additional harness for connection, thereby reducing loss while achieving a higher electrical efficiency. In addition, a control switch may also be provided on the outwardly extending wire 230, and the wire 230 connected on the control switch is connected to the respective phase terminals on the control circuit board 210, whereby to allow for On/Off control.

Figure 4:
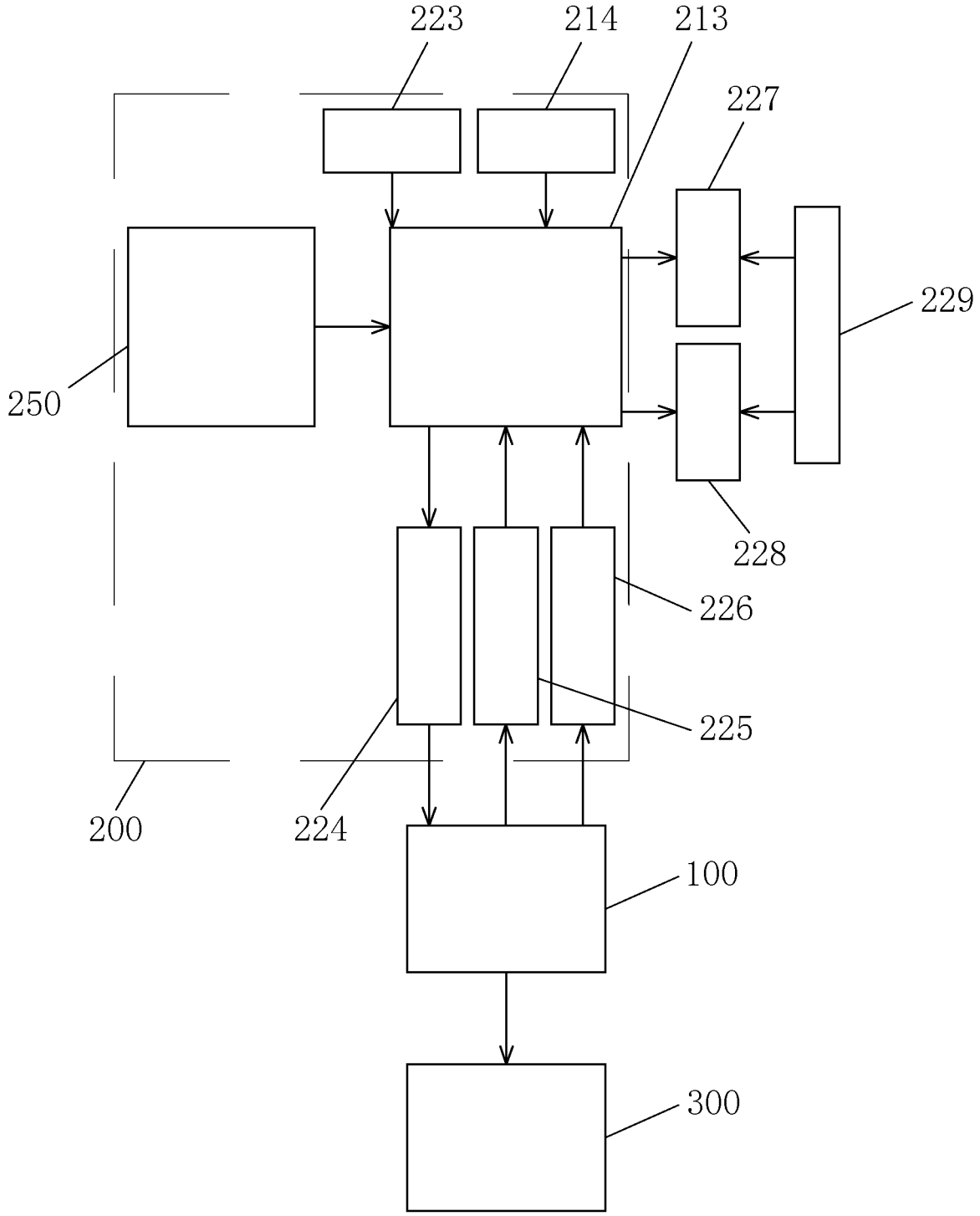
FIG. 4 is a block diagram showing the controller in the first implementation of the winch with a permanent magnet brushless motor and a controller according to the disclosure.

FIG. 4 is a block diagram showing a control structure of the brushless motor 100. A central processor 213 is further provided on the control circuit board 210 and connected to a status display 214 and a data memory 223. In addition, the central processor 213 is further connected to a data closed-loop controller 224. The data closed-loop controller 224 actuates the brushless motor 100 to rotate, the brushless motor 100 drives the reduction gearbox 300 to rotate, the reduction gearbox 300 drives the drum 410 to rotate for rope extension and retraction. A troubleshooting module 225 and a data acquisition module 226 are further connected between the brushless motor 100 and the central processor 213. An angle sensor chip is a portion of the data acquisition module 226. The data acquisition module 226 is configured to transmit relevant operating parameters of the brushless motor 100 to the central processor 213. The central processor 213 is further connected with a wired controller 227 and a wireless controller 228, which are configured to input a control signal. The wired controller 227 and the wireless controller 228 are both connected with a power supply 229 or a battery pack, which are configured to supply power to the wired controller 227 and the wireless controller 228. The central processor 213 is further connected with an adaptive power supply 250 so as to be adapted to different power input specifications.

The control circuit board 210 has a data storage functionality, for carrying out wired remote control or wireless remote control of the operation of the winch and one or more accessories (e.g., the connected display in the vehicle, automatic stop of the rope 20, etc.) in response to a wired or wireless control input from an operator of an external power supply or external power pack. In this implementation, the control circuit board 210 may comprise a motor speed sensor, a motor current sensor, a voltage sensor, a motor direction sensor, a motor location sensor, a motor temperature sensor, and a drum 410 rotation sensor. The control circuit board 210 may input a signal for a connected external device to display a status.

The control circuit board 210 may be further electrically connected to respective phase terminals of the stator 110, and the control circuit board 210 is energized by wired remote control or wireless remote control. The data acquisition module 226 on the control circuit board 210 may be configured to read signals from a cylinder magnet 150 disposed on the magnet mount 140 to detect a position of the rotor 130 in real time. The stator 110 produces a rotating magnetic field with a direction uniformly varied, such that the rotor 130 may rotate with the magnetic field. For example, the control circuit board 210 may perform soft start, measure motor rotation speed, and motor revolving direction.

The control circuit board 210 may comprise an instruction stored therein. The instruction is configured for instructing one or more sensors (such as temperature sensor, current sensor, and voltage sensor) to correspondingly output and remotely display statuses. In this implementation, the temperature sensor, the current sensor, and the voltage sensor are integrated on the control circuit board 210.

In an implementation, the data acquisition module 226 may be provided with a voltage sensor for measuring the operating voltage of the motor. The data acquisition module 226 may monitor (e.g., measure) an output of the voltage sensor and compare a difference between measured voltages. In the case of an overly large difference, the control circuit board 210 may shut down the motor, thereby eliminating the need for an additional electrical connector or an additional voltage system, whereby to suspend operating of the winch so as to protect the winch or the winched vehicle or object.

In an implementation, the data acquisition module 226 may be provided with a soft start functionality. The controller 200 monitors an output of the sensor, enabling the brushless motor 100 to output a stable rotation speed so as to reach the rotation speed required by the rated torque, thereby protecting the winch or the winched vehicle or object.

In an implementation, the data acquisition module 226 may be provided with a temperature sensor to measure temperature rise of the control circuit board 210. The controller 200 may monitor an output of the temperature sensor and compare a difference between measured values. If the difference exceeds a set value, the controller 200 may shut down the motor, eliminating the need for an additional electrical connector or an additional temperature measuring system, whereby to suspend operating of the winch so as to protect the winch or the winched vehicle or object.

In an implementation, the data acquisition module 226 may be provided with a current sensor to measure operating current of the motor. The controller 200 may monitor an output of the current sensor and compare a difference between the measured current and the rated current. In the case that if the difference exceeds a set value, the controller 200 may shut down the motor, eliminating the need for an additional electrical connector or an additional current measuring system, so as to suspend operating of the winch so as to protect the winch or the winched vehicle or object.

Second Implementation

Figure 5:
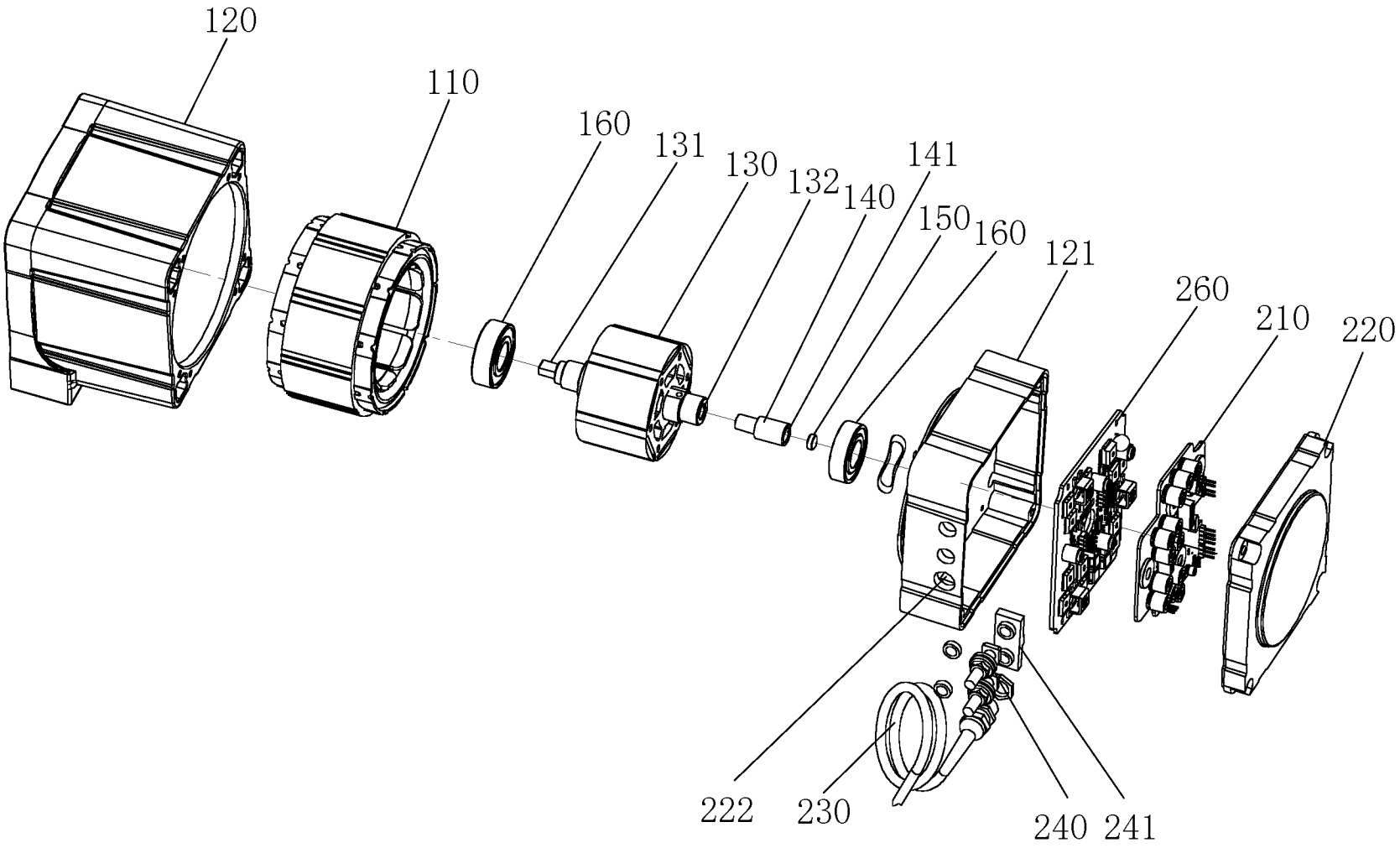
FIG. 5 is an exploded view of a second implementation of the winch with a permanent magnet brushless motor and a controller according to the disclosure.

As illustrated in FIG. 5, this implementation differs from the first implementation in that the winch is DC (direct current) powered. The outwardly extending wiring lug 240 of the winch and a control line are mounted on a plane of the motor tail cap 121 side, and the controller 200 comprises a power board 260 and a control circuit board 210. The power board 260 and the control circuit board 210 are connected via an intermediate medium (e.g., a threaded conductive spacer). The wiring lug 240 extends towards the inner cavity of the motor tail cap 121. The wire 230 and the control circuit board 210 are connected at respective points via an intermediate medium (e.g., connection terminal, etc.), and the wire 230 is mounted at the opening 222 side of the outer surface of the motor tail cap 121. A wiring lug snap 241 is mounted in a plane of the inner side of the motor tail cap 121. A circular through-hole is provided on the surface of the wiring lug snap 241. The wiring lug 240 passes through the wiring lug snap 241 to extend outside the motor tail cap 121, and the portion of the wiring lug 240 extended outside is sleeved in an O-shaped seal ring. The O-shaped seal ring is squeezed to the plane of the outer surface of the motor tail cap 121 via an intermediate medium and a fastener (e.g., a round insulation pad and a flange nut) to prevent an external detrimental substance from intruding into the controller 200 to damage the controller 200. The controller 200 is mounted in the inner cavity formed by the motor tail cap 121 and the controller end cap 220 being combined, and the wire 230 extending outward from the controller 200 in the inner cavity formed by the motor tail cap 121 and the controller end cap 220 being combined may be mounted in the opening 222 at the motor tail cap 121 side via an intermediate medium (e.g., a water-proof connector, etc.).

Those contents not detailed in this implementation may refer to the first implementation.

Third Implementation

Figure 6:
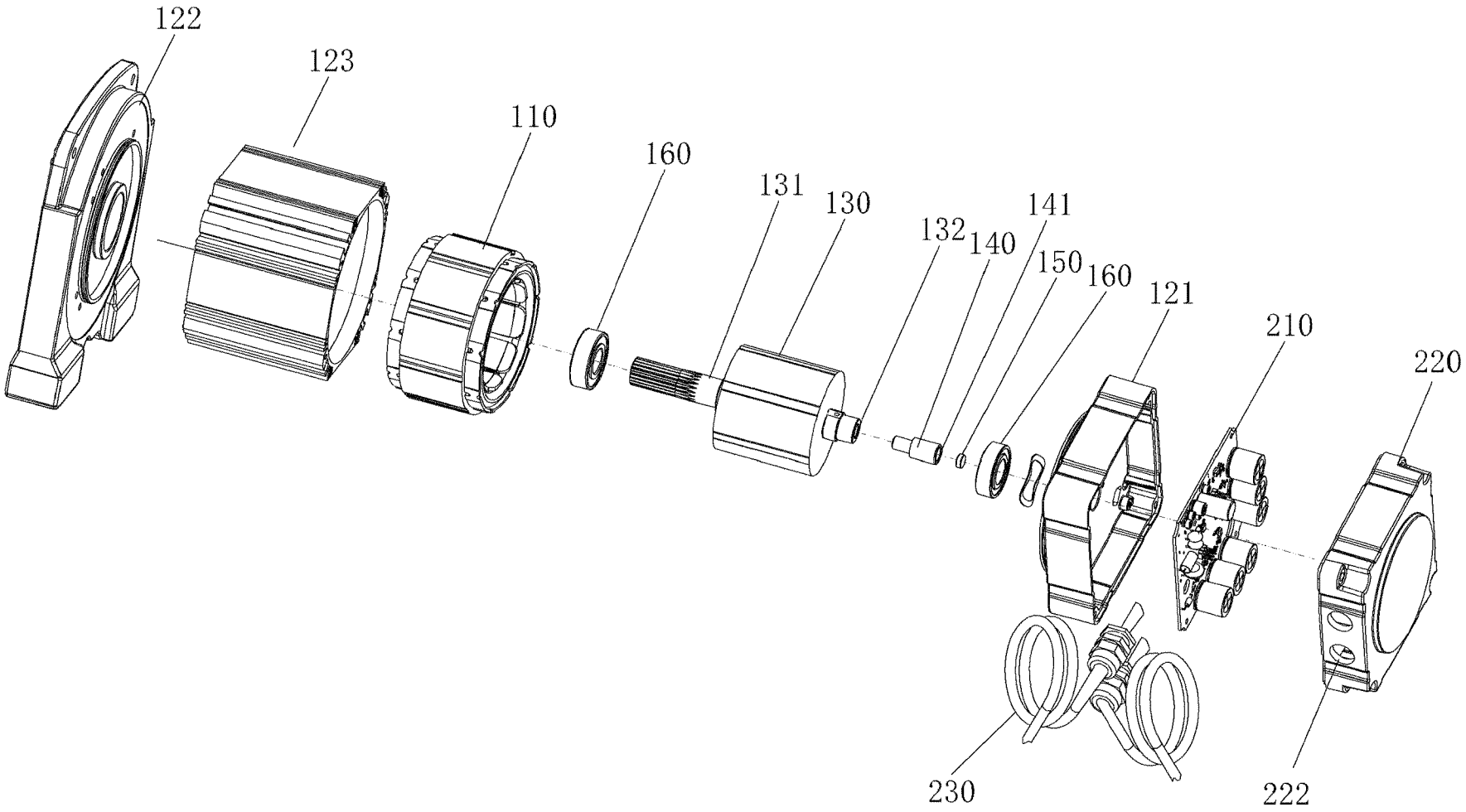
FIG. 6 is an exploded view of a third implementation of the winch with a permanent magnet brushless motor and a controller according to the disclosure.

As illustrated in FIG. 6, this implementation differs from the first implementation in that the motor bracket 120 of the brushless motor 100 comprises a motor end cap 122 and a motor casing 123. In the first implementation, the motor end cap 122 and the motor casing 123 are integrally formed with each other. While in this implementation, the motor end cap 122 and the motor casing 123 are separately provided. The motor casing 123 is a housing with both ends communicating along the axial direction. One end of the motor casing 123 is fastened with the motor end cap 122 via a bolt, and the other end of the motor casing 123 is fastened with the motor tail cap 121 via a bolt; both ends of the motor casing 123 are closed with the motor end cap 122 and the motor tail cap 121, respectively.

Those contents not detailed in this implementation may refer to the first implementation.

Fourth Implementation

Figure 7:
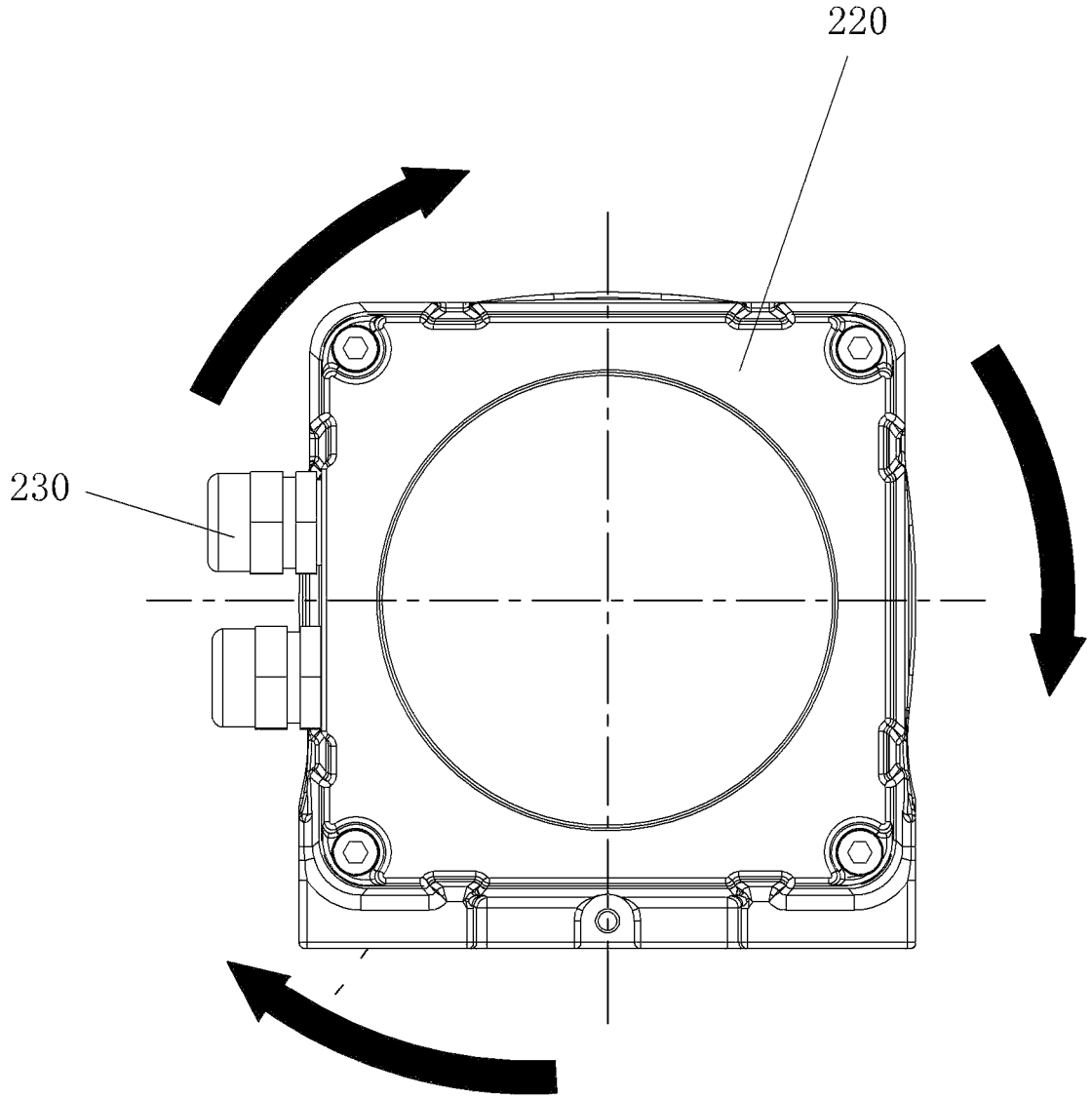
FIG. 7 is a schematic diagram showing a structure of a fourth implementation of the winch with a permanent magnet brushless motor and a controller according to the disclosure.

As illustrated in FIG. 7, this implementation differs from the first implementation in that the cross section of the accommodation cavity 221 is square, i.e., the controller end cap 220 can all be fastened with the motor tail cap 121 via a bolt after rotating by 90°, 180° or 270°, such that the user may rotate till an appropriate direction for the opening 222 based on the winch mounting position so as to facilitate layout of the wire 230. Of course, the cross section of the accommodation cavity 221 may also be other shapes such as regular polygonal or round, so as to facilitate adjusting the wire 230 to be mounted from an appropriate position.

Those contents not detailed in this implementation may refer to the first implementation.

Fifth Implementation

Figure 8:
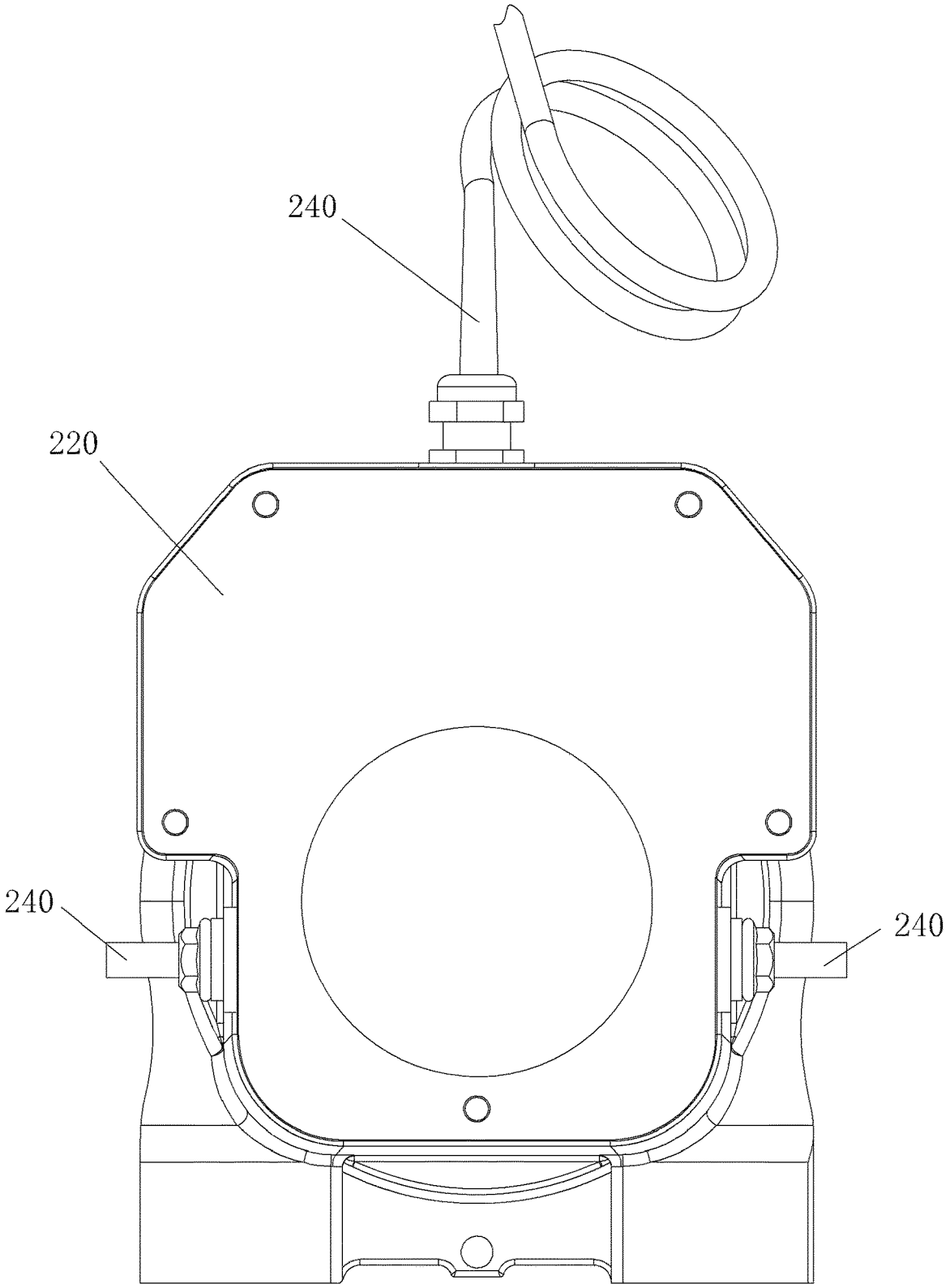
FIG. 8 is a stereoscopic view of a fifth implementation of the winch with a permanent magnet brushless motor and a controller according to the disclosure.
Figure 9:
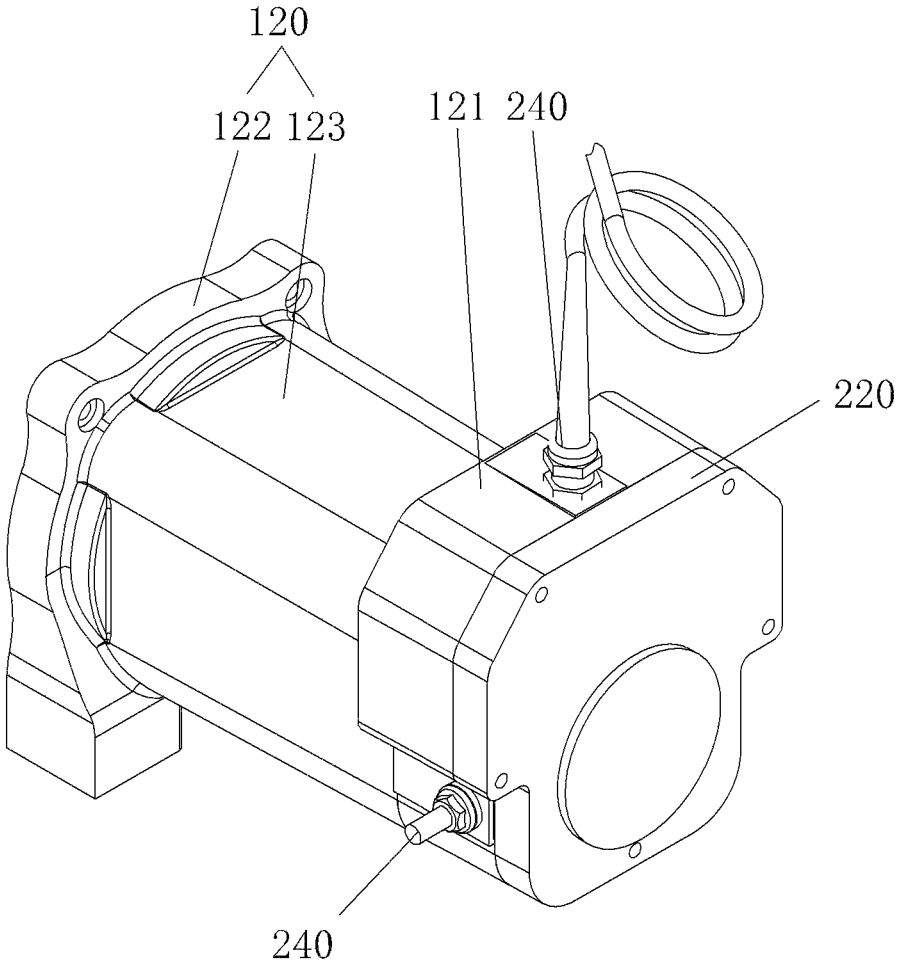
FIG. 9 is a right view of the fifth implementation of the winch with a permanent magnet brushless motor and a controller according to the disclosure.

As illustrated in FIG. 8 and FIG. 9, this implementation differs from the second implementation in that the motor bracket 120 comprises a motor end cap 122 and a motor casing 123. The size of the outer profile of the motor casing 123 is smaller than that the size of the motor end cap 122 and the size of the motor tail cap 121. The motor casing 123 and the motor end cap 122 may be of an integral structure or a separate structure. The motor tail cap 121 and the circuit board in the controller 200 may have a symmetrical or asymmetrical shape. The outwardly extending wiring lug 240 and the connected power supply line may be disposed on different side surfaces of the motor tail cap 121, while the control line connected to the controller 200 is disposed on a same or different side surface of the motor tail cap 121 with respect to the wiring lug 240. The motor bracket 120, the motor tail cap 121, and the controller end cap 220 are fastened via an intermediate medium such as a fastening bolt (not shown).

Those contents not detailed in this implementation may refer to the second implementation.

Sixth Implementation

Figure 10:
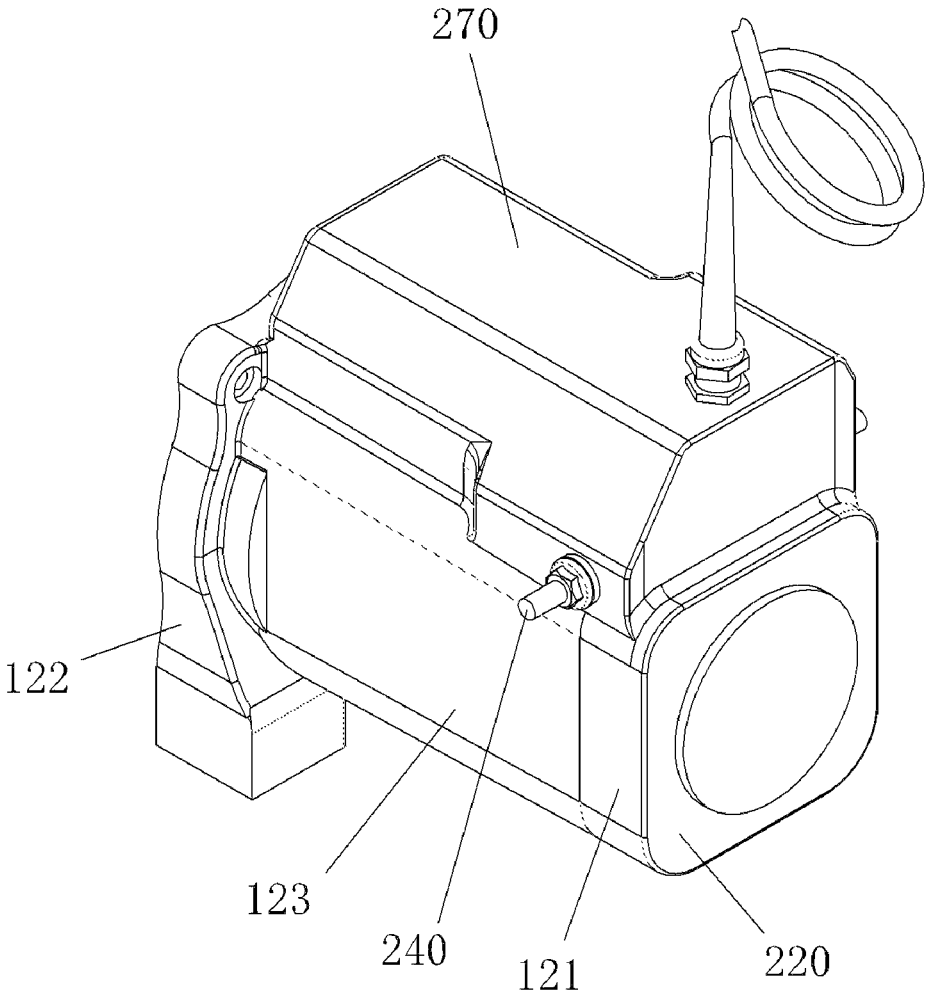
FIG. 10 is a stereoscopic view of a sixth implementation of the winch with a permanent magnet brushless motor and a controller according to the disclosure.
Figure 11:
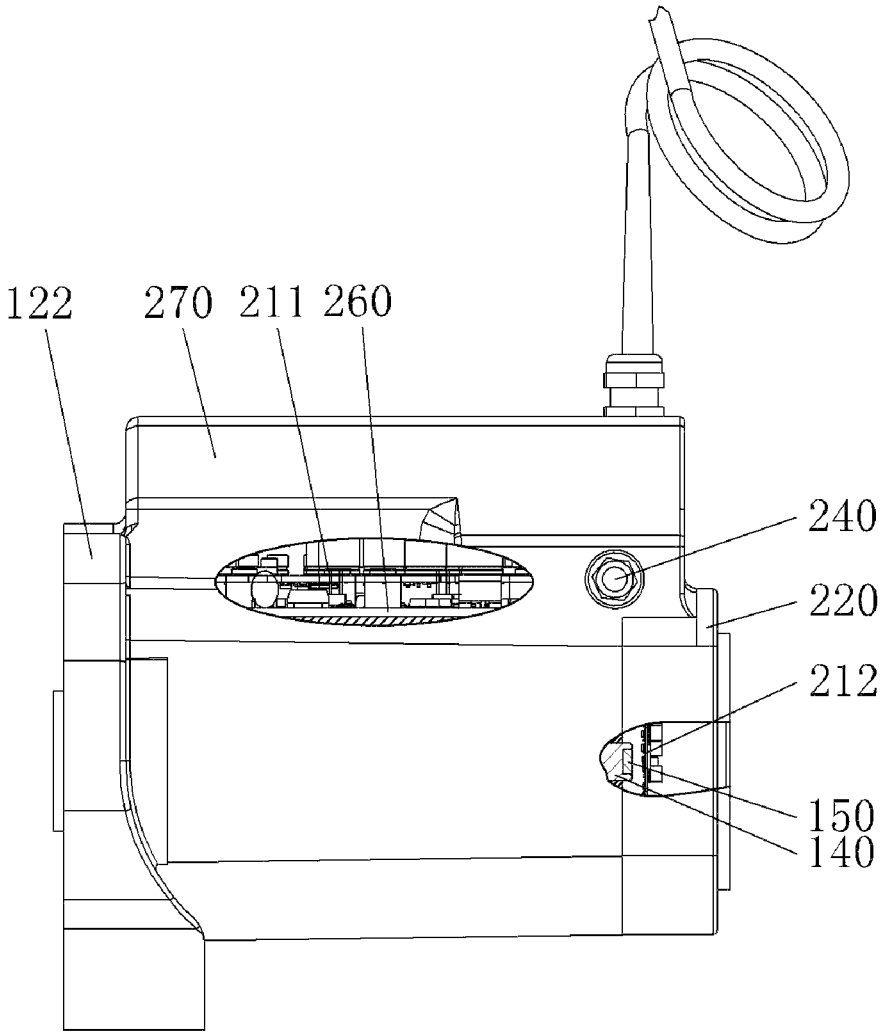
FIG. 11 is a right view of the sixth implementation of the winch with a permanent magnet brushless motor and a controller according to the disclosure.

As illustrated in FIG. 10 and FIG. 11, this implementation differs from the second implementation in that the controller 200 may be disposed at a position parallel to the motor casing 123. The controller 200 comprises a power board 260 and a control circuit board 210. The control circuit board 210 comprises a control main board 211 and an encoder board 212. The encoder board 212 is connected to the power board 260 and a control main board 211 via an intermediate medium (e.g., wire). In addition to the controller end cap 220, the controller 200 further comprises a housing 230. The encoder board 212 is fixed in an accommodation cavity 211 formed by the controller end cap 220 and the motor tail cap 121 being combined, the housing 270 is fixed on the motor casing 123, and the housing 270 may directly form an enclosed chamber in conjunction with the motor casing 123. Alternatively, both ends of the housing 270 may be shared with the motor tail cap 121 and the motor end cap 122, such that the housing 270, the motor tail cap 121, the motor end cap 122, and the motor casing 123 jointly form an enclosed chamber.

The power board 260 is disposed in the housing 270, and the control main board 211 may be disposed in the housing 270. Alternatively, the control main board 211 may be disposed in the accommodation cavity 211. The wiring lug 240 may be disposed on the motor casing 123 or the housing 270.

Those contents not detailed in this implementation may refer to the second implementation.

What have been described above are only specific examples of the disclosure. However, the technical features of the disclosure are not limited thereto. Any alteration or modification made by those skilled in the art fall within the scope of the disclosure.

What is claimed is:

1. A winch integrated with a permanent magnet brushless motor and a controller, comprising a brushless motor and a controller, wherein the brushless motor comprises a stator having a wire coil, and a motor bracket, the stator is fixedly provided in the motor bracket, a rotor and a rotating shaft fixed in a rotor center are provided inside the stator, the rotating shaft is rotatably connected to the motor bracket, one end of the rotating shaft is fixedly connected with a magnet mount, and a cylinder magnet is mounted in the magnet mount; wherein the controller comprises a control circuit board, the control circuit board is fixed to one end of the motor bracket proximal to the cylinder magnet; and wherein a chip is provided on the control circuit board for sensing angle of the rotor in conjunction with the cylinder magnet.

2. The winch integrated with a permanent magnet brushless motor and a controller according to claim 1, wherein the motor bracket comprises a motor tail cap, the controller further comprises a controller end cap, and an accommodation cavity is formed between the motor tail cap and the controller end cap; and wherein the cylinder magnet passes through the motor tail cap to extend into the accommodation cavity, and the control circuit board is fixed in the accommodation cavity.

3. The winch integrated with a permanent magnet brushless motor and a controller according to claim 2, wherein an opening is provided in a sidewall of the accommodation cavity, and a wire passes through the opening and is connected to the control circuit board.

4. The winch integrated with a permanent magnet brushless motor and a controller according to claim 3, wherein a cross section of the controller end cap has a regular polygonal or round shape; a recessed cavity is provided in the controller end cap; the motor tail cap encloses the recessed cavity to form the accommodation cavity; and the opening is provided in a sidewall of the recessed cavity.

5. The winch integrated with a permanent magnet brushless motor and a controller according to claim 2, wherein an opening is provided in a sidewall of the accommodation cavity, a wiring lug is provided in the opening, and the control circuit board and the wire are electrically connected to the wiring lug respectively.

6. The winch integrated with a permanent magnet brushless motor and a controller according to claim 1, wherein the stator comprises an iron core and a three-phase wire coil wound around the iron core, and the three-phase wire coil is connected to a corresponding contact on the control circuit board.

7. The winch integrated with a permanent magnet brushless motor and a controller according to claim 1, wherein a first fixation hole running along an axis of the rotating shaft is provided in an end surface of the rotating shaft, one end of the magnet mount is adapted to the first fixation hole; a second fixation hole running co-axially with the rotating shaft is provided at another end of the magnet mount, and the cylinder magnet is fixed in the second fixation hole.

8. The winch integrated with a permanent magnet brushless motor and a controller according to claim 1, wherein the motor bracket comprises a motor end cap, a motor casing, and a motor tail cap, one end of the motor casing is integrally formed with the motor end cap, another end of the motor casing is detachably connected to the motor tail cap; or, the motor bracket comprises the motor end cap, the motor casing, and the motor tail cap, the motor end cap is detachably connected to one end of the motor casing, and the another end of the motor casing is detachably connected to the motor tail cap.

9. The winch integrated with a permanent magnet brushless motor and a controller according to claim 8, wherein a front end of the rotating shaft is rotatably connected on the motor end cap via a bearing, and a rear end of the rotating shaft is rotatably connected on the motor tail cap via a bearing.

10. The winch integrated with a permanent magnet brushless motor and a controller according to claim 1, wherein the stator comprises an iron core, and the iron core is stamped-out and laminated from a silicon steel sheet.

11. The winch integrated with a permanent magnet brushless motor and a controller according to claim 1, further comprising a reduction gearbox, a drum, and a rope wound around the drum; the other end of the rotating shaft actuates the reduction gearbox to rotate via a driving rod, the reduction gearbox drives the drum to rotate, and the drum brings the rope to wind to realize pulling of the winch.

* * * * *